United States Patent [19]

Tremoulet, Jr.

[11] Patent Number: 4,936,512

[45] Date of Patent: Jun. 26, 1990

[54] NOZZLE ASSEMBLY AND METHOD OF PROVIDING SAME

[75] Inventor: Olivier L. Tremoulet, Jr., Edmonds, Wash.

[73] Assignee: Flow International Corporation, Kent, Wash.

[21] Appl. No.: 284,108

[22] Filed: Dec. 14, 1988

[51] Int. Cl.[5] ..... B05B 1/00

[52] U.S. Cl. ..... 239/596; 239/600; 29/890.143; 285/379; 277/169; 277/170; 277/171; 277/198; 277/DIG. 6

[58] Field of Search ..... 239/596, 600; 29/157 C; 285/379, 380; 277/168–172, 176, 192, 198

[56] References Cited

U.S. PATENT DOCUMENTS 759,324 5/1904 Stevens ..... 285/380
4,244,521 1/1981 Guse ..... 239/600 X
4,660,773 4/1987 O'Hanlon ..... 239/600 X
4,754,929 7/1988 Struve et al. ..... 239/600 X

*Primary Examiner*—Andres Kashnikow
*Assistant Examiner*—William Grant
*Attorney, Agent, or Firm*—Hughes & Multer

[57] ABSTRACT

A seal assembly having a first seal member made of a deformable material which maintains its deformed configuration after release of the deforming force. The seal in a preformed condition is placed around the rear end of a retaining insert, with a nozzle element also being placed within the seal member. The assembled components are inserted in the discharge end of a high pressure housing which is then pressurized to cause the seal material to deform into sealing of engagement and also to grip the insert and the nozzle element to form a unitary nozzle assembly which can easily be removed from the housing.

15 Claims, 3 Drawing Sheets

NOZZLE ASSEMBLY AND METHOD OF PROVIDING SAME

BACKGROUND OF THE INVENTION

1. Field of the Invention

The present invention relates to a nozzle assembly, such as a nozzle assembly which is adapted to discharge a high pressure liquid as a jet, and more particularly to such a nozzle assembly which can be easily inserted into, and removed from, the discharge opening of a high pressure housing.

2. Background Art

For a number of years, apparatus has been provided for pressurizing a liquid (e.g. water) to a high pressure (e.g. 25,000 pounds per square inch or more) and discharging this water as a high velocity jet to accomplish cutting, abrading or some other operation. One of the critical components in such an apparatus is the discharge nozzle assembly. With liquid accelerating into and through the nozzle element at a very high velocity, there can be relatively rapid wear or deterioration, and this requires frequent removal of the nozzle assembly for replacement, repair or inspection periodically.

One type of nozzle assembly which has been in use for a number of years is one which employs a sapphire nozzle element which is positioned in the discharge opening of the high pressure housing, and a retaining screw which holds the nozzle in position. This retaining screw has a forward or downstream portion which threads into the near or upstream part of the opening in the housing and a rear portion of reduced diameter which, in addition to positioning the nozzle element, provides support for a polymeric seal that surrounds both the nozzle element and the rear portion of the retaining screw. The polymeric seal is initially provided as a cylindrical member which is inserted into the end opening of the high pressure housing, and fluid pressure within the chamber of the housing causes the seal to extrude forwardly into sealing engagement with the retaining screw and the housing wall which defines the discharge opening.

One of the problems with that design has been that when the assembly is removed from the opening, the screw is initially removed, but the nozzle element and the seal would remain in the opening. Then various methods would have to be used to remove the seal and the nozzle element from the opening. Another concern has been that a fully adequate seal was not always obtained.

SUMMARY OF THE INVENTION

The present invention was conceived to alleviate the problems recited above. The present invention provides a nozzle assembly which is capable of properly performing its sealing function, and also is formed in a manner that the components inter-engage one another so that these may be removed from the high pressure housing as a single unit. Also included in the present invention is a method of forming the nozzle assembly into its proper sealing configuration, and yet accomplishing the inter-engagement of the components so that these are formed as an easily removeable single unit.

The nozzle assembly of the present invention has a longitudinal axis and is adapted to fit into the discharge opening of the housing structure, this discharge opening being defined by an interior wall surface of the housing. The assembly comprises a retaining insert which is adapted to be removeably secured in the discharge opening at a forward location, this insert having a through axially aligned discharge passage. The insert has a rearwardly and radially outwardly positioned seal surface spaced radially inwardly of the wall of the housing that defines the discharge opening when the insert is positioned in the discharge opening.

There is a nozzle element positioned in the discharge opening rearwardly of the insert. This nozzle element has an orifice to discharge a fluid stream, with this nozzle element being retained in the discharge opening by the insert.

There is a first seal member made of a first deformable material, capable of being deformed under pressure, and characterized in that it remains in a deformed condition after release of said pressure. The first seal member has a forward seal portion which fits in sealing engagement between the radially outwardly positioned seal surface of the insert and the wall surface of the housing. It also has a rear seal portion which surrounds and grips the nozzle element.

A second seal member is provided, this being made of a yielding resilient sealing material, and fitting between a radially outward surface of the first seal member and the wall surface of the housing.

The nozzle assembly is characterized in that the first seal member and the radially outwardly positioned seal surface of the insert have inter-engaging tongue and groove means which restrains relative movement between the insert and the first seal member. With this arrangement, the seal assembly can be removed from the housing as a unit.

In one configuration, the insert has in a rear end portion thereof a radially outwardly facing shoulder which inter-engages the first seal member to form the tongue and groove means. Another arrangement is that the seal has at least one raised and one recessed portion to engage matching recessed and raised portions of the first seal member.

Also, in the preferred configuration, the first seal member is formed with an outer circumferential groove to receive a second seal member which extends circumferentially around said first seal member. Desirably, the radially outward portion of the first seal member which is located rearwardly of the second seal member is at least partially spaced from the wall of the housing to permit high pressure fluid in the housing chamber to reach the second seal member.

Also, in the preferred embodiment, the insert has a forward threaded portion which engages matching threads in the discharge opening of the housing. Further, in the preferred configuration, the radially outwardly positioned seal surface of the insert has a forward seal surface portion which tapers radially inwardly in a rearward direction away from said wall of the housing, and this forward seal surface portion of the insert is engaged by a matching surface portion of the first seal member in sealing engagement.

In the method of the present invention, the insert, nozzle element and second seal member are provided as described above. However, the first seal member is provided in a pre-formed configuration, where the first seal member has a generally cylindrical configuration by which it can be inserted over and around the rear portion of the insert. The first seal member is also formed with an outer circumferential groove to receive the second seal member. The nozzle element is fitted within the first seal member. At this stage, the frictional engagement of the components is sufficient to hold these together. Then the assembly is inserted into the discharge opening of the high pressure housing.

Then when high pressure fluid flows into the chamber, the pressure of this fluid causes the first seal member to deform so that the material surrounding the rear portion of the insert flows against the radially outward surface of the rear portion of the insert to form the tongue and groove connection. In addition, in the preferred configuration, the forward portion of the first seal and its preformed configuration flows forwardly so as to come into proper sealing engagement with the forward seal surface portion of the insert. Desirably, the insert is made of metal (e.g. steel) or some other high strength material having comparable characteristics. The first seal is a plastic material which is capable of being deformed under high pressure, and when so deformed, remains in the deformed configuration. Desirably, this material deforms under relatively high pressure (e.g. above 25,000 psi), and remains in the deformed configuration. A polymer or ultrahigh molecular weight polyethylene have been found suitable for the first seal material. Other candidates for use as a first seal material are cross linked polymers and any other plastic materials that are highly resistant to extrusion under pressure.

The material for the second seal member is desirably an elastomeric material which, upon deformation, returns to its original configuration after deforming forces are removed. The second seal material can be in the form of an O-ring. Candidates for the material to be used for the second seal are rubber, nitrite, polyurethane or any other elastic and resilient material.

Other features of the present invention will become apparent from the following detailed description.

DESCRIPTION OF THE PREFERRED EMBODIMENTS

Figure 1:
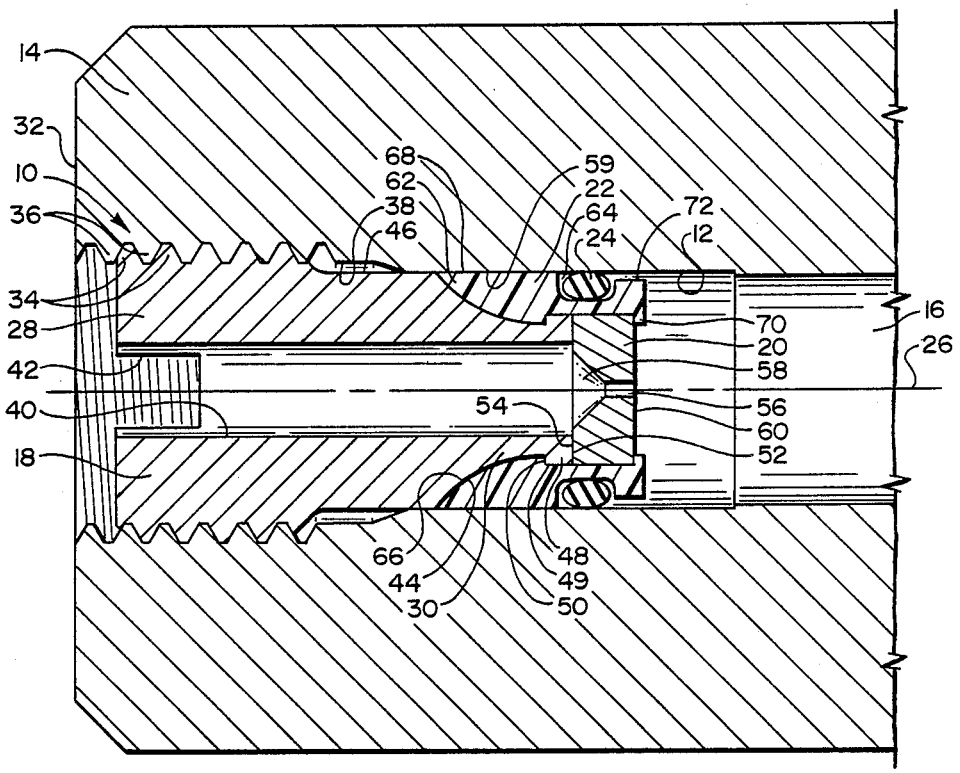
FIG. 1 is a longitudinal sectional view showing the nozzle assembly of the present invention in its assembled operating configuration.

The nozzle assembly 10 of the present invention is shown in its finished operating configuration in FIG. 1, being mounted in a cylindrical discharge opening 12 of a high pressure housing 14 defining a high pressure chamber 16. The nozzle assembly 10 comprises four main components; namely a retaining insert 18, a nozzle element 20, a first seal member 22 and a second seal member 24. The insert 18 has the overall configuration of a surface of revolution about a longitudinal center axis 26. This insert 18 can be considered as having a forward mounting portion 28, and a rear sealing and retaining portion 30.

The forward mounting portion 28 has an overall cylindrical configuration, and when installed, fits a short distance inwardly from the front face 32 of the housing 14. The forward part of the forward insert portion 28 is formed with exterior threads 34 that engage matching threads 36 formed in the cylindrical interior wall 38 of the housing 14. Further, the insert 18 is formed with a cylindrical through opening 40. At the forward end of the insert 18, there is provided a transverse slot 42 to receive a screw driver or the like so that the insert can be threaded into secure engagement with the housing 14 or removed therefrom.

The rear sealing and retaining portion 30 of the insert 18 has a radially outwardly facing surface portion 44 that tapers from the outer cylindrical surface 46 of the forward surface portion radially inwardly in a rearward direction. As shown herein, this surface portion 44 has in a section taken through the longitudinal axis 26 a moderately concave configuration.

The extreme rear portion of the rear insert portion 30 is expanded outwardly peripherally as at 48 to form a radially outwardly extending flat surface 49 and a forwardly facing circumferential lip or shoulder 50. As will be described more fully hereinafter, the formation of this lip or shoulder 50 provides inter-engagement with the adjacent portion of the first seal member 22 so as to form the assembly 10 as a single unit which can be easily removed from, and inserted into, the opening 12 of the housing 14.

The rearwardly facing annular surface 52 of the insert 18 butts against a matching annular surface 54 of the nozzle element 20. This nozzle element 20 is or may be of a conventional configuration and, as shown herein, it is formed as a cylindrical disc of sapphire or some other suitable material, having a nozzle orifice 56 which leads forwardly into a forwardly and outwardly expanding conical recess 58. The rear surface 60 of the nozzle element 20 has a flat circular configuration, and its perimeter surface is cylindrical.

The aforementioned first seal member 22 serves essentially three functions. First, the forward portion 62 of the first seal member 22 comes into sealing engagement with the insert surface portion 44 and the adjacent portion of the rear portion 59 of the interior wall 38 of the housing 14. Second, the first seal member 22 provides a seat for the second seal member 24 in the form of a circumferential groove 64 formed at the rear outer portion of the first seal member 22. Third, the radially inward portion of the first seal member 22 comes into gripping engagement with both the nozzle element 20 and the rear insert portion 30 to cause the assembly 10 to be removeable as a unit from the housing 14.

To describe the first seal member 22 more specifically, the forward seal portion 62 has a radially inwardly facing surface portion 66 which fits in sealing engagement against the rearwardly and inwardly tapering portion 44 of the insert 18, and an outer cylindrical surface portion 68 which fits against the housing wall surface 59. As will be described more particularly hereinafter, when the seal member 22 is in its preformed condition and mounted as part of the assembly and is mounted in the housing 14, and when there is high fluid pressure in the chamber 16, the seal member 22 deforms from its initial installed position to flow into firm engagement with the adjacent surface portions. Thus, a portion of the material of the first seal member 22 flows radially inwardly to come into engagement with the forwardly facing lip or shoulder 50, thus providing, in effect, what might be termed aprotrusion/recess, or tongue and groove, or lip and shoulder interconnection between the first seal member 22 and the insert 18. In addition, the rear inner edge portion of the first seal member 22 forms an inwardly extending circumferential retaining lip or flange 70 which retains the nozzle element 20 in its position adjacent to the rear end of the insert 18. The rear radially outwardly facing surface portion 72 of the first seal member 22 is, as shown in FIG. 1, spaced moderately inwardly from the housing wall 59. It has been found that it is desirable to permit at least some leakage from the chamber to the second seal member 24 so that the second seal member 24 can properly perform its sealing function.

Suitable materials for the material for the first seal member are any class of polymer that resists extrusion at pressures up to 60,000 psi or above such as ultra high molecular weight polyethylenes, cross linked polymer materials, etc.

The second seal member 24 can conveniently be provided in the form of a conventional O-ring of an elastomeric material which has sufficient resiliency so that it will deform under pressure but return to its original configuration when the deforming forces are removed. Suitable materials for such an O-ring can be rubber, nitrite, neoprene, polyurethane or any other such elastic material.

To describe the operation of the present invention, when high pressure fluid is directed into chamber 16, so as to cause a high velocity jet to flow through the orifice 56, the fluid pressure bears against the rear surface of the first seal member 22 to cause it to come into wedging seal engagement with the insert surface portion 44 and the housing wall surface 59. In addition, the pressure against the second O-ring seal 24 forces it into sealing engagement between the first second seal 22 and the housing wall 59.

As indicated previously, the action of the very high pressure liquid tends to cause erosion or wear on the nozzle element 20 causing a deterioration of the jet quality. Accordingly, as discussed previously, it becomes necessary to remove the assembly 10 periodically for repair, replacement or possibly simply inspection. This can be immediately accomplished by inserting a screw driver into slot 42 and rotating the insert 18 out of engagement with the housing 14. Since the first seal member 22 is in firm gripping engagement with both the insert 18 and the nozzle element 20, the entire assembly 10 is removed as a unit from the housing 14. Yet, this arrangement provides proper sealing, even under very high pressure.

Figure 2:
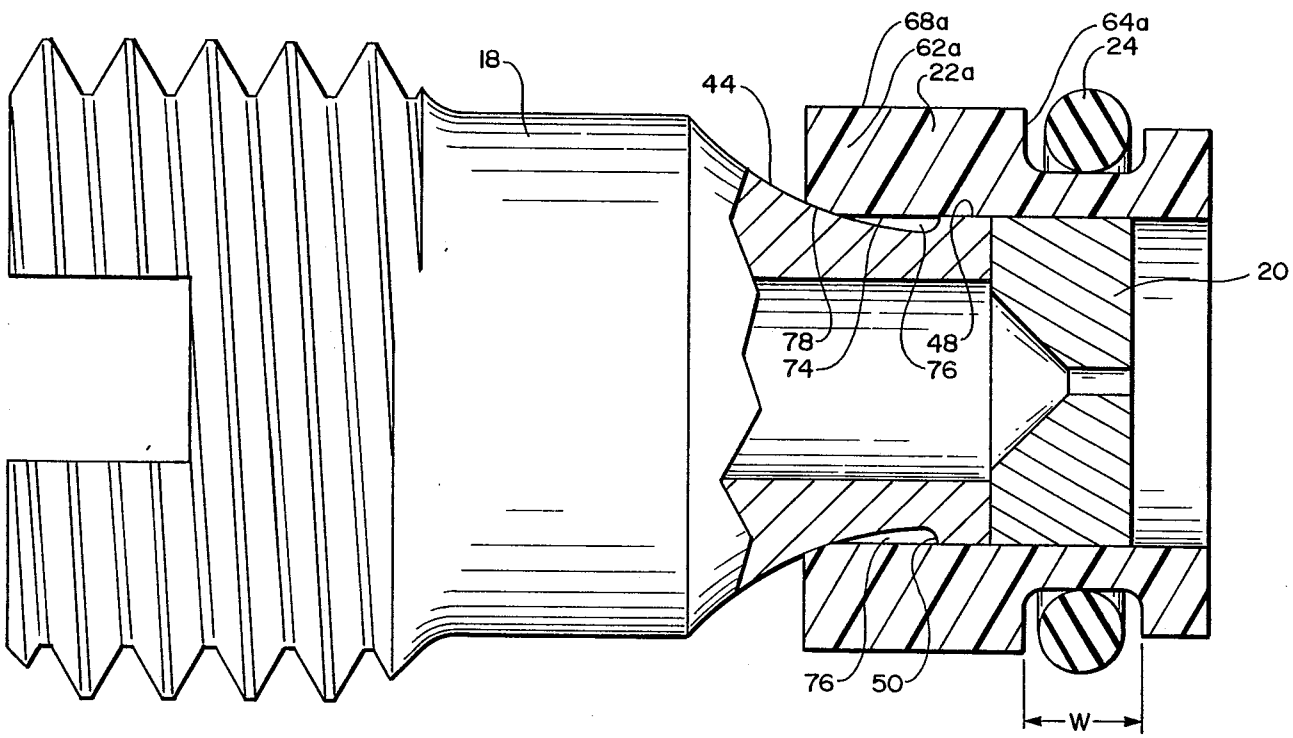
FIG. 2 is a side elevational view of the nozzle assembly of the present invention in its preformed condition, and ready for installation into the discharge opening of the high pressure housing.

To describe the manner in which the assembly 10 is initially assembled in its preformed configuration, reference is now made to FIG. 2. The insert 18, the nozzle element 20 and the second O-ring seal member 24 have substantially the same configuration in the preformed arrangement as in the final operating configuration. Accordingly, those components will be given their same numerical designations. However, it can readily be seen that the first seal member 22 has a preformed configuration differing from the final configuration shown in FIG. 1. Accordingly, for purposes of description, the first seal member 22 in its preformed condition will have the components or portions thereof which correspond to those of the final configuration be given like numerical designations with an "a" suffix distinguishing those of the first seal member 22 in its preformed condition.

Thus, it can be seen that the first seal member 22*a* has its forward portion 62*a* having a substantially cylindrical configuration, with an outer cylindrical surface portion 68*a* and an inner cylindrical surface portion 74. This inner surface portion 74 is dimensioned so that it can be slipped over the rear expanded portion 48 of the insert 18, and so that the nozzle element 20 can be inserted into the first seal member 22*a*. The fit of the first seal member 22*a* with the nozzle element 20 and the rear expanded portion 48 of the insert 18 is sufficiently snug so that there is adequate frictional engagement so that these components in their assembled condition (as shown in FIG. 2) can easily be inserted as a unit into the opening 12 of the housing 14.

Also, the first seal member 22*a* is formed with the groove 64*a* to receive the second O-ring seal 24. The width dimension (shown at "w" in FIG. 2) of the preformed groove 64*a* is moderately greater than the diameter of the O-ring 24 (e.g. 40% to 50% greater) to allow for compression of the groove width during deformation of the preformed first seal member 22*a*. It will be noted that in the preassembled configuration of FIG. 2, that the inner surface 74 of the first seal member 22*a* forms with the rear portion of the tapering curved surface portion 44 of the insert 18 an annular gap 76 which is located just forwardly of the lip or shoulder 50 of the rear part of the insert 18. Also, the radially inward forward surface portion of the first seal member 22*a* is tapered as at 78 to match the contour of the adjacent area of the surface portion 44 of the insert 18, this taper being substantially caused by assembly as shown.

With the assembly 10 in its assembled condition, as shown in FIG. 2, this assembly 10 is inserted into the opening 12 of the housing 14, and the insert 18 is rotated to bring the sets of threads 34 and 36 into proper retaining engagement. As indicated previously, when high pressure liquid is directed into chamber 16, the first seal member 22 is caused to deform so as to extrude forwardly into sealing engagement with a substantial portion of the insert surface portion 44 and to flow into the gap 76 so as to come into retaining position relative to the shoulder 50. Also, there is some deformation of the first seal member 22*a* forwardly around the second O-ring seal 24, and also the aforementioned deformation to form the lip or flange 70 which holds the nozzle element 20 in place.

It is to be recognized that various modifications can be made without departing from the basic teachings of the present invention. For example, in FIGS. 3A through 3D there are shown various configurations of the rear outer surface portion of the insert 18. For convenience of illustration, only half of the rear portion of insert 18 is shown in section in FIGS. 3A through 3D.

Figure 3A:
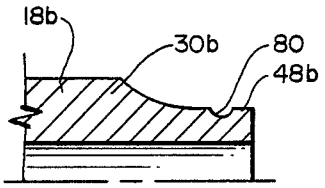
FIGS. 3A through 3D show four alternative configurations for the rear portion of the retaining insert, with only the upper rear portion of the retaining insert being shown in section.

In FIG. 3A, the rear portion 30*b* of the insert 18*b* is formed with a circumferential groove 80 positioned just forwardly of the annular expanded rear portion 48*b*.

Figure 3B:
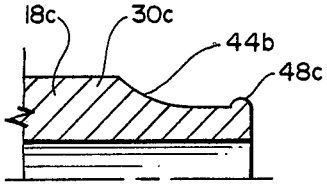

In FIG. 3B, the rear insert portion 30*c* is formed with the expanded rear portion 48*c* having a semi-circular rounded configuration. Further, the surface portion 44*b* has a more frusto-conical configuration.

Figure 3C:
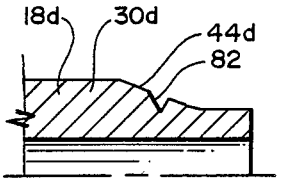

In FIG. 3C, there is provided a groove 82 in a frusto-conical surface portion 44*d* of the rear insert portion 30*d*.

Figure 3D:
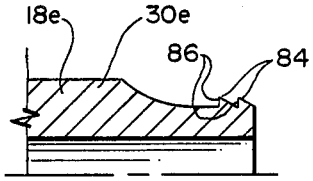

In FIG. 3D, the outer surface of the rear portion 30*d* of the insert 18*e* is formed with two upstanding ridges 84, which have a rear outwardly facing surface that slopes outwardly and forwardly, with each of these forming forwardly facing annular surface portions 86.

It can be seen that the arrangement shown in FIG. 1, as well as the arrangements shown in FIGS. 3A through 3D, each show a lip and shoulder interfit (or tongue and groove interfit) between the insert 18 and the first seal member 22. In each instance, there are one or more raised surface portions on one of the insert 18 and the first seal member 22 and also one or more recessed areas on the other which receive the raised portions of the other member.

It is readily apparent that with any one of the configurations shown in FIGS. 3A through 3D, the material of the first seal in the preformed condition 22*1* is able to extrude and fill the recesses provided in any of the various configurations shown in FIGS. 3A through 3D.

What is claimed is:

1. A high pressure nozzle assembly having a longitudinal axis and adapted to fit into a discharge opening of a housing structure where said housing structure has a rearwardly positioned high pressure chamber and an interior discharge wall surface which defines said discharge opening at a location forwardly of said high pressure chamber, said assembly comprising:

a. a retaining insert adapted to be removably secured in said discharge opening at a forward location and having a through axially aligned discharge passage, said insert having a rearwardly and radially outwardly positioned seal surface spaced radially inwardly of said discharge wall surface when the insert is positioned in said discharge opening, and a forwardly positioned retaining portion by which said retaining insert is retained in said discharge opening;

b. a nozzle element positioned in said discharge opening rearwardly of said insert and having a discharge orifice to discharge a fluid stream through said discharge passage, with said nozzle element being retained in said discharge opening;

c. a first seal member made of a first deformable material capable of being deformed under pressure and characterized in that it remains in a deformed condition after release of said pressure, said first seal member having a forward seal portion which fits in sealing engagement between the radially outwardly facing seal surface of the insert and said wall surface, and a rear seal portion which surrounds and grips said nozzle element said rear seal portion having a rear surface area exposed to pressure in said high pressure chamber to cause said forward seal portion to press against a rearwardly facing surface area of said insert and to cause said forward seal portions to press in sealing engagement radially outwardly and radially inwardly;

d. a second seal member which is made of a yielding resilient seal material and which fits between a radially outward surface of said first seal member and said wall surface; and e. said nozzle assembly being characterized in that said first seal member and the radially outwardly positioned seal surface of the insert having inter-engaging tongue and groove means which is pressed into interfitting relationship by pressure in the rear surface portion of the first seal member from said high pressure chamber and which restrains relative movement between said insert and said first seal member, and whereby said first seal member is secured to said insert and to said nozzle element with sufficient securing force so that said seal assembly can be removed from said housing as a unit.

2. The assembly as recited in claim 1, wherein said insert has at a rear end portion thereof, a radially outwardly positioned shoulder which inter-engages said first seal member to form said tongue and groove means.

3. The assembly as recited in claim 1, wherein said insert has at least one groove means to receive material of said first seal member.

4. The assembly as recited in claim 1, wherein said insert has at least one raised portion engaging a matching recessed portion of said first seal member.

5. The assembly as recited in claim 1, wherein said first seal member is formed with a groove adjacent a radially outward surface portion thereof to receive said second seal member.

6. The assembly as recited in claim 5, wherein said second seal member extends circumferentially within said groove around said first seal member.

7. The assembly as recited in claim 5, wherein said second seal member comprises an O-ring.

8. The assembly as recited in claim 1, wherein said insert has at a forward end thereof threads which threadedly engage matching threads in said housing structure.

9. The assembly as recited in claim 1, wherein said rearwardly and radially outwardly positioned seal surface tapers inwardly and rearwardly toward a rear end portion of said insert.

10. A method of forming a nozzle assembly having a longitudinal axis and adapted to fit into a discharge opening of a housing structure, where said housing structure has a rearwardly positioned high pressure chamber and an interior discharge wall surface which defines said discharge opening at a location forwardly of said high pressure chamber, said method comprising:

a. providing a preformed assembly which comprises:

i. a retaining insert adapted to be removably secured in said discharge opening at a forward location and having a through axially aligned discharge passage, said insert having a rearwardly and radially outwardly positioned seal surface spaced radially inwardly of said discharge wall surface when the insert is positioned in said discharge opening, and a forwardly positioned retaining portion by which said retaining insert can be retained in said discharge opening;

ii. a nozzle element adapted to be positioned in said discharge opening rearwardly of said insert and having a discharge orifice to discharge a fluid stream through said discharge passage;

iii. a first seal member made of a first deformable material capable of being deformed under pressure and characterized in that it remains in a deformed condition after release of said pressure, said first seal member having a generally annular configuration with a central opening having a diameter sufficiently large to receive therein said nozzle element and a rear end portion of said retaining insert in a preassembled configuration, said insert and said seal member being configured with a portion of tongue and groove means adjacent to said first seal member, said first seal member also being provided with a radially outward groove means;

iv. a second seal member which is made of a yielding resilient seal material and which is adapted to fit within said radially outward groove means;

b. assembling said insert, nozzle element, first seal member and second seal member by placing said nozzle element in said first seal member and mounting said seal member over the rear portion of the retaining insert, and also placing the second seal member in the radially outward groove means of the first seal member so as to provide a preformed assembly;

c. placing said preformed assembly into the discharge opening of the housing structure and securing said insert in said housing structure;

d. directing pressurized fluid in the high pressure chamber in said housing structure in a manner that said fluid bears against a rearwardly facing surface portion of said first seal member to cause said first seal member to extrude forwardly so as to come into sealing engagement with the seal surface of the retaining insert and the interior discharge wall surface, and so that said first seal member deforms radially inwardly to come into tongue and groove engagement with said insert and also to deform into interfitting engagement with said nozzle element;

whereby said insert, nozzle element, first seal member and second seal member provide a unitary assembly which can be removed from said housing structure as a unit, and which can permit discharge of high pressure fluid through said nozzle element while maintaining a proper seal with said housing structure.

11. The method as recited in claim 10, wherein said insert has at a rear end portion thereof a radially outwardly positioned shoulder which interengages said first seal member to form said tongue and groove means.

12. The method as recited in claim 10, wherein said insert has at least one raised portion, and said first seal member becomes deformed so as to provide a matching recessed portion of said first seal member.

13. The method as recited in claim 10, wherein said second seal member comprises an O-ring.

14. The method as recited in claim 10, wherein said insert has at a forward end thereof threads, said method further comprising rotating said insert into threaded engagement with matching threads in said housing structure.

15. The method as recited in claim 10, wherein said first seal member has a rear portion thereof which deforms radially inwardly to come into gripping engagement with said nozzle element.

* * * * *

UNITED STATES PATENT AND TRADEMARK OFFICE
Certificate

Patent No. 4,936,512 Patented: June 26, 1990

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is: Oliver L. Tremoulet, Jr. and Thomas J. Hagman.

Signed and Sealed this Fourteenth Day of May, 1991.

ANDRES KASHNIKOW, *S.P.E.*

*Patent Examining Group 310*
*Art Unit 314*